US005085386A

United States Patent [19]

Hicks et al.

[11] Patent Number: 5,085,386

[45] Date of Patent: Feb. 4, 1992

[54] PAINTBRUSH HOLDER

[75] Inventors: Thomas W. Hicks, 7 Heather Street, Toronto, Ontario, Canada, M4R 1Y2; Ron Hodgins, Guelph, Canada

[73] Assignee: Thomas W. Hicks, Richmond Hill, Canada

[21] Appl. No.: 499,968

[22] Filed: Mar. 27, 1990

[51] Int. Cl.[5] ..... A46B 17/02

[52] U.S. Cl. ..... 248/110

[58] Field of Search ..... 248/110, 111, 112

[56] References Cited

U.S. PATENT DOCUMENTS

| | | | |
|---|---|---|---|
| D. 173,189 | 10/1954 | Clark, Sr. | 248/110 |
| 2,184,460 | 12/1939 | Linder | 248/110 |
| 2,487,516 | 11/1949 | Braswell | 248/110 |
| 2,542,737 | 2/1951 | Vogel | 248/111 |
| 2,625,299 | 1/1953 | Uhlig | 248/110 X |
| 4,275,818 | 6/1981 | Church | 248/110 X |
| 4,377,239 | 3/1983 | Jimae | 248/110 X |
| 4,660,245 | 4/1987 | Anderson | 248/110 X |
| 4,757,568 | 7/1988 | Jones | 248/110 X |
| 4,832,293 | 5/1989 | Gizzi | 248/110 |

*Primary Examiner*—Gary L. Smith
*Assistant Examiner*—Michael Milano

[57] ABSTRACT

The present invention relates to a paintbrush holder comprising a structure having a forward face, generally of constant width at the bottom region thereof, and tapering upwardly to a brush handle receiving slot which includes two arms either side of the slot which project forward of the face. The holder at the bottom edge includes a container engaging arrangement adapted to engage the rim of a conventional paint can and support the holder at an upwardly extending angle outwardly from the rim of the conventional paint can. Preferably, the paintbrush holder is of a one piece structure and can advantageously be made by injection moulding. In a preferred form of the invention, the paintbrush holder is nestable, one within the other, for convenient storage by various merchandisers.

16 Claims, 4 Drawing Sheets

PAINTBRUSH HOLDER

FIELD OF THE INVENTION

The invention relates to paintbrush holders.

BACKGROUND OF THE INVENTION

A number of arrangements have been proposed for holding of a paintbrush in a particular position relative to a supporting paint can. Such structures allow the user a convenient manner of supporting of a paintbrush relative to a paint can and avoids the problem of positioning the paintbrush on the container rim when not in use.

The prior art structures, as exemplified in U.S. Pat. Nos. 2,184,460, 4,014,453, 3,729,158, 3,948,413, and 4,832,293, are relatively complicated and do not provide for a simple means of supporting of the paintbrush holder on a conventional paint can as well as on other related paint container edges. Furthermore, these structures are quite complicated and thus have not found significant success in the marketplace.

The structure of U.S. Pat. No. 2,184,460 is quite complicated, requires two supports either side of the container and thumb screw adjustments for maintaining engagement of the support on the container edge. Such an arrangement is difficult to manufacture and is not convenient to use.

U.S. Pat. No. 3,948,413 discloses a different structure which supports the brush by engaging the lower edge thereof and uses an upwardly angled support surface for further support of the brush. With this arrangement, paint accumulates in the lower trough and the bristles of the brush are used for support which generally is not desirable.

U.S. Pat. No. 3,729,158 defines a metal arrangement for engaging the edge of a conventional paint can in combination with a magnet for suspending of a paintbrush adjacent the paint holder. Again, this arrangement is not easily manufactured and suffers from the perception that the brush is not particularly well supported.

U.S. Pat. No. 4,832,293 discloses a unique arrangement for supporting of a paintbrush in combination with other functions by utilizing the bale of the paint can. This again is a fairly complicated arrangement and, to applicant's knowledge, has not been accepted in the marketplace.

There remains a need to provide a simple paintbrush holder which is easy to manufacture, supports the paintbrush in an acceptable manner, and also provides for easy use by the end user with respect to multiple paint containers.

SUMMARY OF THE INVENTION

A paintbrush holder according to the present invention comprises a structure having a forward face generally of constant width at the bottom region thereof and tapering upwardly to a brush handle receiving slot which includes two arms either side of said slot which project forward of the face. The holder at the bottom edge includes a container engaging means adapted to engage the rim of a conventional paint can and support the holder in an upwardly and outwardly extending angle from the rim of the conventional paint can. The container engaging means has two separate and distinct gripping areas adapted for snuggly engaging paint containers of different rim configurations.

According to a preferred embodiment of the invention, the paintbrush holder is nestable, one within another.

According to yet a further aspect of the invention, the container engaging arrangement is provided in the sidewalls of the holder adjacent the bottom edge of the container.

According to yet a further aspect of the invention, the container engaging arrangement is a slot opening at the lower edge of sidewalls provided either side of the brush support face. These sidewalls are each slotted to have a first side of a slot having a lip for engaging under a container rim and a second side of the slot having a stop face for engaging the exterior of the container adjacent the rim. In yet a further aspect of the invention, the slot includes a reduced in width slot area for engaging an edge of a paint tray or paint bucket and disposing the paintbrush support face at an angle extending upwardly and outwardly from the support edge.

According to yet a further aspect of the invention, the support face of the brush is curved to essentially only engage the outer edges of the brush and particularly the bristle outer edge portions.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 3:
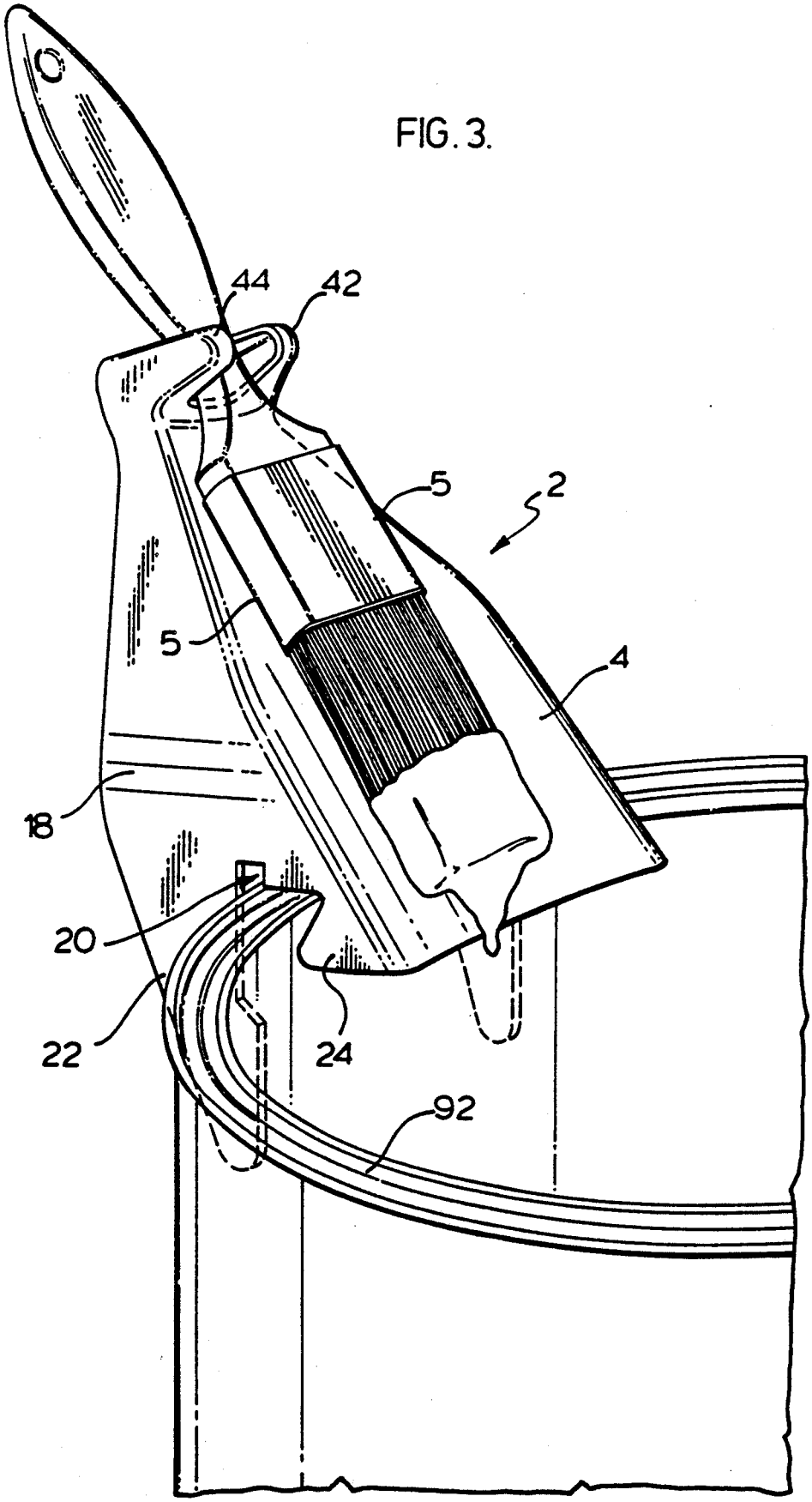
FIG. 3 is a perspective view of the brush holder on a conventional paint can.
Figure 4:
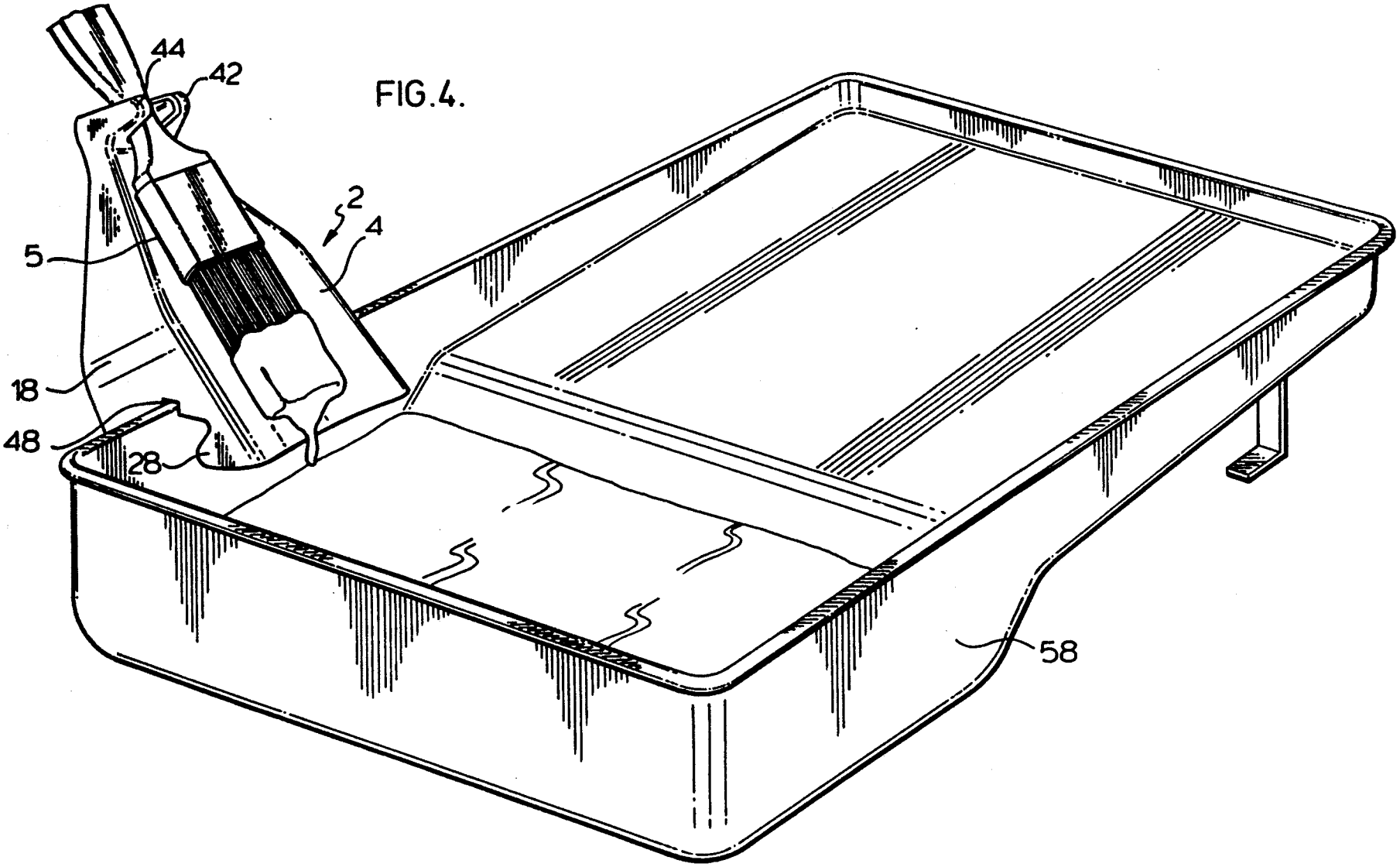
FIG. 4 is a perspective view of the brush holder on a conventional paint tray.

The paintbrush holder 2, generally shown in the drawings, has a brush support portion or face 4 which is curved across the surface thereof. This curve allows the brush to be generally supported at its edges 5, as generally shown in FIG. 3. With this arrangement, the bristles in between the support edges are generally free and paint which drips therefrom hits the face 4 and returns to the container. The holder 2 includes sidewalls 18 having a container engaging portion, generally shown as 20. The container engaging portion 20 includes an exterior arm 22 for engaging the exterior of a support container and an interior arm 24 for engaging the interior surface of the container adjacent the support edge thereof. Between the exterior arm and the interior arm is a slot 26. This slot includes a lip 28 which defines an undercut portion, generally shown as 30. The exterior arm 22 also includes an undercut portion, generally shown as 32. With this arrangement, the undercut portion 30 associated with lip 28 accommodates the inwardly projecting rim 92 of a conventional paint can 90 with the exterior arm providing a stop face 34 for engaging the container side. With this arrangement, the paintbrush holder can be lockingly engaged with the rim of the container such that the brush holder 2 extends upwardly and outwardly at an angle from the support edge.

Figure 5:
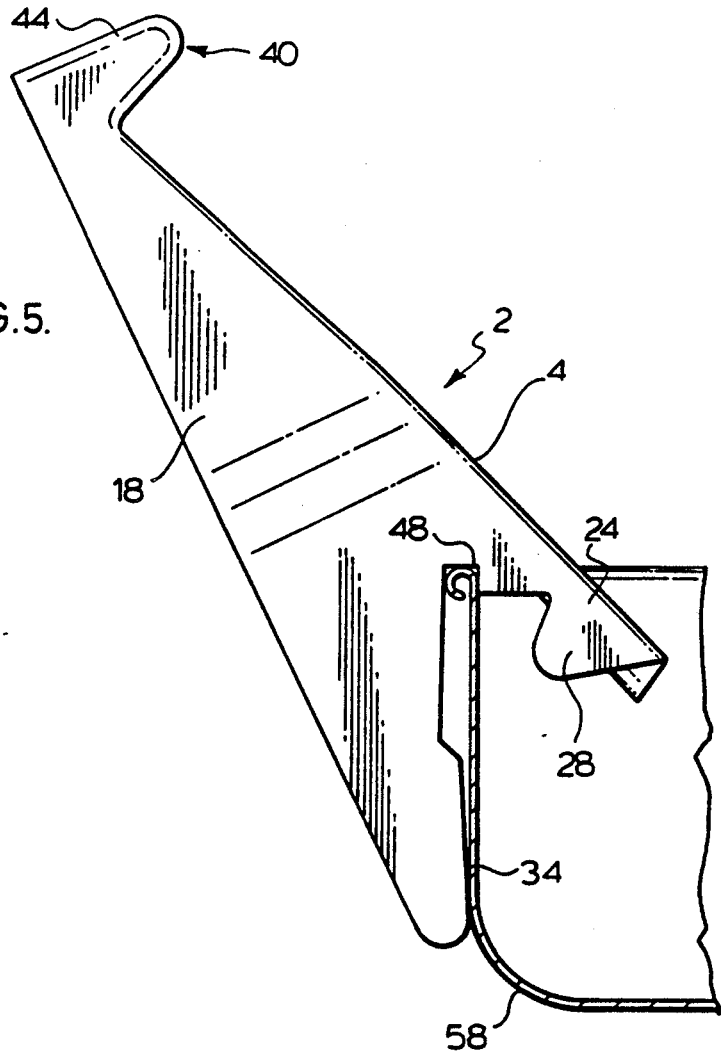
FIG. 5 is a sectional view of the paintbrush holder on the paint tray.
Figure 6:
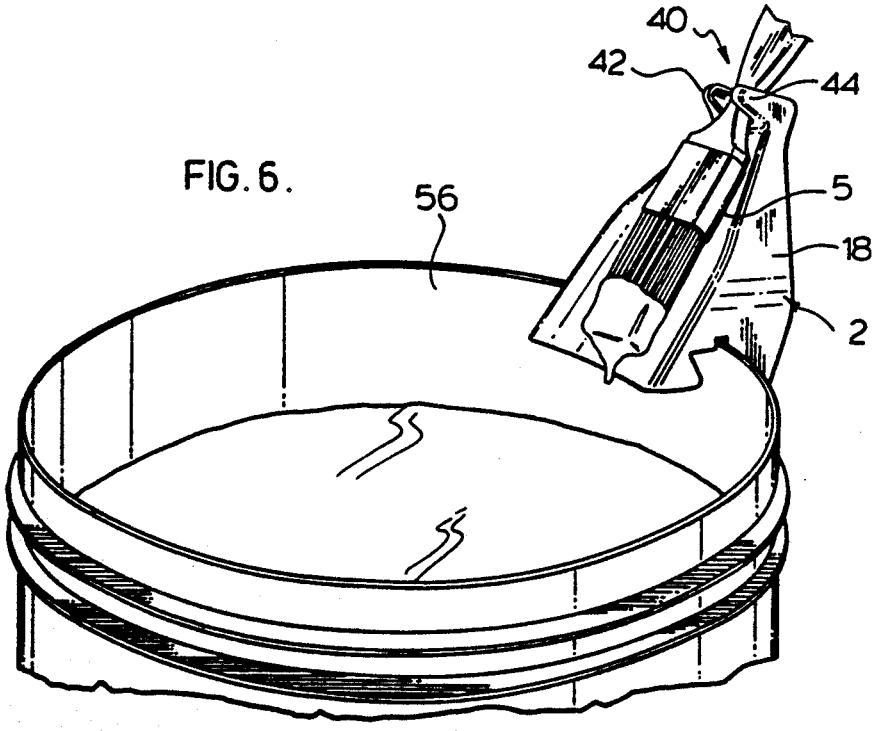
FIG. 6 is a perspective view of the paintbrush holder on a rimless paint pail.

The slot 26 includes a further reduced slot area 48 for engaging the support edge of a paint pail or rimless paint tray. A paint pail is generally shown as 56 in FIG. 6 with the paint tray shown as 58 in FIG. 5. In rimless structures, the support edge does not include an inwardly extending flange area, such as is common with a conventional paint can, and as such, the reduced slot area 48 is used and provides a secure engagement on the edge of a paint pail 56 or the paint tray 58. The brush holder 2 is maintained in its upwardly outwardly angled position due to the snug fit and the bias created by the gravitational force of the holder and brush which causes the slot to firmly engage these surfaces. The resulting moment on the support edge would not be sufficient to cause a disturbance thereto, particularly when the tray or paint pail is holding a certain amount of paint. With the rimmed paint tray of FIG. 5 lip 28 engages the interior of the paint tray and stop face 34 engages the exterior of the paint tray.

Figure 1:
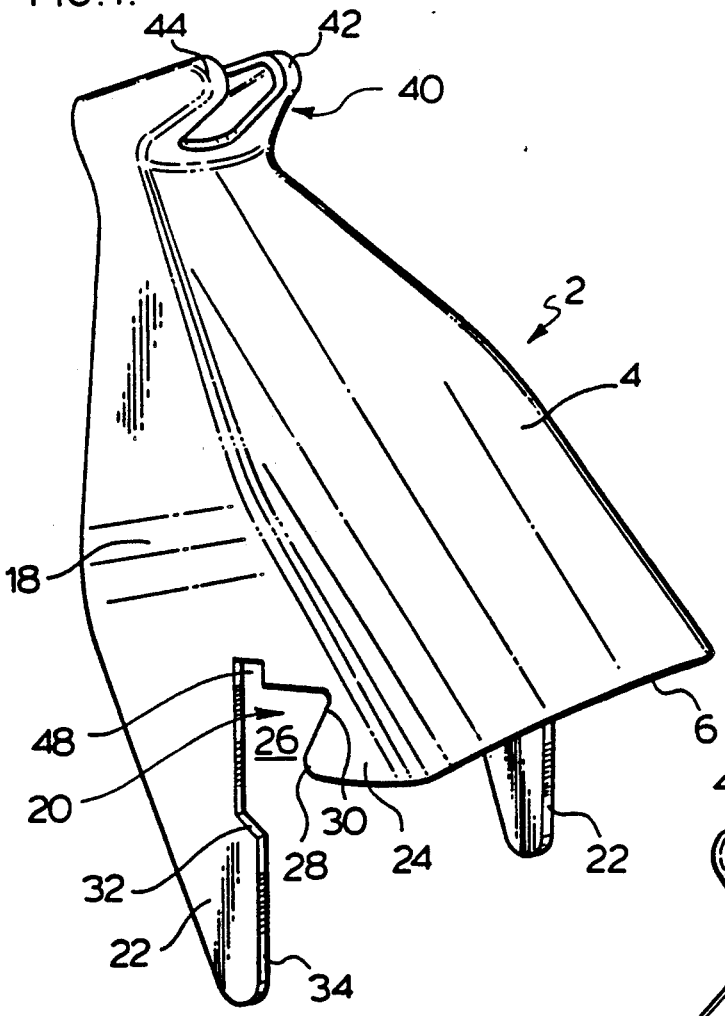
FIG. 1 is a front perspective view of the brush holder.
Figure 2:
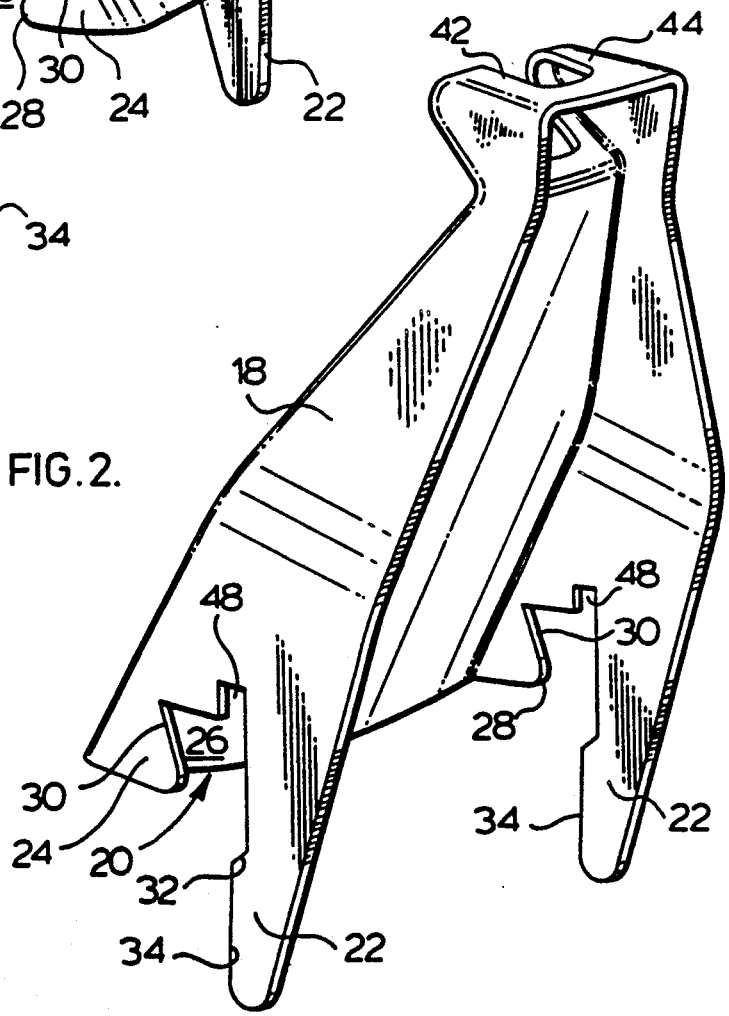
FIG. 2 is a rear perspective view of the brush holder.

The paintbrush holder, as generally disclosed herein, has several advantages. The first advantage is that it is of a shape to be nestable, one atop the other, as can be appreciated from FIGS. 1 and 2. This nestable aspect of the paintbrush holder makes it particularly desirable for merchandising by large merchandisers. The nestable arrangement reduces storage space, which is often at a premium in such merchandising outlets. A further feature of the invention is in its single, one piece structure which can advantageously be an injection moulded plastic. This allows the manufacturing costs to be low and with reasonable volume the cost is essentially the material cost. The symmetrical shape of the holder 2 also allows the product to be made in two sections and subsequently secured. The paintbrush holder 2 is also very convenient for the end user and adaptable for support on multiple paint equipment without manual adjustment of the securing mechanism. As illustrated the holder 2 is mountable on at least 3 commonly used containers, namely a paint can, a paint pail, and a paint tray and is usable with widely varying brush sizes making it applicable for the majority of painting applications.

The paintbrush holder 2 also includes a brush handle engaging portion 40 defined by the two arms 42 and 44. These arms project forwardly of the support face 4 and are wider at the upper surface and slightly narrower at the bottom surface defining a downwardly tapering throat portion. With this arrangement, the brush, which is held within the paintbrush holder by the progressively reducing throat portion of the paintbrush handle between arms 42 and 44, allows the brush to be suspended from the arms. Thus, the bristles of the brush do not bear any of the load and do not become bowed or bent. Furthermore, with this arrangement, the bottom edge 6 of the brush support 4 may be used as a wiping surface when the holder is secured and the locking fit is such that it provides firm resistance for the wiping of paint from the paint bristles. As previously described, the brush support portion 4 is slightly concave such that a brush supported in the holder is generally held by the two arms 42 and 44 which take most of the weight with some support being provided adjacent the edges of the paintbrush. It is only these edge regions which intimately contact the support face 4 and the bristles in between these support edges are generally above the support portion 4 and out of direct contact therewith.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A paintbrush holder comprising a brush support portion, a brush handle engaging portion, a container engaging portion, said brush support portion cooperating with said brush handle engaging portion to support a brush secured therein at an angle to allow paint which drips from such brush to flow down said support away from said handle engaging portion, said handle engaging portion being located at one end of said brush support portion and projecting forward thereof for engaging a restricted area in the length of a handle of a brush, said container engaging portion including a slotted arrangement adjacent one end of said brush support opposite said brush handle engaging portion with said slotted arrangement including two separate and distinct grip areas, said two separate and distinct gripping areas including a first cavity sized for engaging the rim of a conventional paint can and a second cavity opening onto said first cavity and of reduced size relative thereto for engaging a rim of a paint tray.

2. A paintbrush holder as claimed in claim 1 wherein said container engaging portion is in sidewalls depending from said brush support portion.

3. A paintbrush holder as claimed in claim 1 wherein said holder is one piece.

4. A paintbrush holder as claimed n claim 3 wherein said holder is plastic.

5. A paintbrush holder as claimed in claim 4 wherein said holder is produced by an injection moulding process.

6. A paintbrush holder as claimed in claim 4 wherein said holder is nestable, one within another.

7. A paintbrush holder comprising a one piece structure having a forward face generally of constant width at the bottom region thereof and tapering upwardly to a brush handle receiving slot which includes two arms either side of said slot which project forward of said face, said holder at said bottom edge including container engaging means adapted to engage the rim of a conventional paint can and support said holder at an upwardly extending angle outwardly from the rim of the conventional paint can; said container engaging means having two separate and distinct grip areas in a sidewall of the paintbrush holder, said two separate and distinct gripping areas including a first cavity sized for engaging the rim of a conventional paint can and a second cavity opening onto said first cavity and of reduced size relative thereto for engaging a rim of a paint tray and disposing said face at an angle extending upwardly and outwardly away therefrom.

8. A paintbrush holder as claimed in claim 7 wherein said paintbrush holder is nestable, one within another.

9. A paintbrush holder as claimed in claim 8 wherein said container engaging means is provided in opposed sidewalls of said holder at said bottom edge.

10. A paintbrush holder as claimed in claim 9 wherein said sidewalls are provided either side of said face.

11. A paintbrush holder as claimed in claim 7 wherein said brush holder is made of an injection moulded plastic.

12. A paintbrush holder as claimed in claim 11 wherein said projecting arms are joined by a traversing member at an upper edge of said holder.

13. A paintbrush holder as claimed in claim 7 wherein said forward face is inwardly depressed across the surface of the width thereof.

14. A paintbrush holder as claimed in claim 13 in combination with a conventional paint can and a paintbrush, said paintbrush holder being lockingly secured to the rim of said conventional paint can and said paintbrush holder supporting said paintbrush by means of said arms engaging a reduced area on the handle of said paintbrush with the bristles of the brush only supported adjacent the edges of the brush.

15. A paintbrush holder as claimed in claim 7 wherein said forward face is concave across the face thereof.

16. A paintbrush holder as claimed in claim 1 wherein said brush support portion is concave in the width thereof.

* * * * *